US005176197A

United States Patent [19]

Hamaguchi et al.

[11] Patent Number: 5,176,197

[45] Date of Patent: Jan. 5, 1993

[54] CONTINUOUS CASTER MOLD AND CONTINUOUS CASTING PROCESS

[75] Inventors: Chiyokatsu Hamaguchi; Tomoharu Shimokasa; Kazumi Daitoku; Fujiya Nogami; Kazuya Kudo; Kazumi Seki, all of Kitakyushi, Japan

[73] Assignee: Nippon Steel Corporation, Tokyo, Japan

[21] Appl. No.: 771,808

[22] Filed: Oct. 8, 1991

Related U.S. Application Data

[63] Continuation of Ser. No. 571,492, Aug. 22, 1990, abandoned.

[30] Foreign Application Priority Data

Mar. 30, 1990 [JP] Japan ..... 2-83530
Jun. 29, 1990 [JP] Japan ..... 2-170289

[51] Int. Cl.[5] ..... B22D 11/04
[52] U.S. Cl. ..... 164/459; 164/418
[58] Field of Search ..... 164/459, 418, 138

[56] References Cited

U.S. PATENT DOCUMENTS 3,381,741 5/1968 Gardner ..... 164/439
4,530,393 7/1985 Rokop et al. ..... 164/437

FOREIGN PATENT DOCUMENTS 212833 8/1956 Australia .
1045743 7/1953 France ..... 164/459
53-32824 3/1978 Japan ..... 164/418
57-79047 5/1982 Japan ..... 164/418
58-13445 1/1983 Japan .
58-120579 7/1983 Japan .
58-141832 8/1983 Japan ..... 164/418
58-173061 10/1983 Japan .
60-221151 11/1985 Japan ..... 164/418
61-195742 8/1986 Japan .
62-114745 5/1987 Japan ..... 164/418
1-93474 4/1989 Japan .

*Primary Examiner*—Kuang Y. Lin

[57] ABSTRACT

A continuous caster mold has a water-cooled inner wall of copper or a copper alloy that is thoroughly covered with pieces of ceramics. A continuous casting process, which uses a mold whose inner wall of copper or a copper alloy is lined with ceramics having resistance to wear, heat and thermal shock, heat conductivity and lubricating property, with the thickness of the ceramics lining varied either stepwise or continuously in the casting direction. The molten metal, which progressively solidifies as its heat is extracted, is withdrawn by taking advantage of the solid lubrication provided by the ceramics lining. The thickness of the lining is varied to prevent the formation of air gaps between the surface of the lining and the solidifying shell and cool the steel being cast according to the desired pattern, and/or to start solidification of the molten metal below the molten metal surface level.

25 Claims, 6 Drawing Sheets

CONTINUOUS CASTER MOLD AND CONTINUOUS CASTING PROCESS

This application is a continuation of now abandoned application, Ser. No. 07/571,492 filed on Aug. 22, 1990.

BACKGROUND OF THE INVENTION

1. Field of the Invention

This invention relates to molds of curved, vertical and horizontal continuous casters for casting slabs, blooms and billets and continuous casting processes using said molds, and more particularly to molds and continuous casting processes that prevent the occurrence of breakout and produce very clean castings free of oscillation marks, surface and other defects.

2. Description of the Prior Art

Molten steel or other molten metal poured into a mold of a continuous caster leaves it as hot cast product after cooling and solidifying with the extraction of heat therefrom. FIG. 1 shows how a solidifying shell is formed and grows. Molten metal 5 is poured into a mold 1 where cooling water passed through cooling water piping 4 contained in the mold cools the molten metal by removing heat therefrom. Then, a solidifying shell 7 is formed and grows where the metal contacts the inner wall of the mold 1. A powder 18 sprinkled over the molten metal 5 protects its surface from an oxidizing atmosphere. Infiltrating between the inner wall of the mold 1 and the solidifying shell 7 as a part of slag 19, the powder 18 serves as a lubricant to prevent the sticking of the solidifying shell 7. The shell 7 solidifies and contracts as it descends through the mold 1 while forming localized air gaps between itself and the inner wall of the mold as a result of the bulging of the shell 7 caused by the recuperative action thereof until the leaving of a cast product therefrom.

When the powder 18 is used in continuous casting, the mold 1 is oscillated so that the powder 18 is fed along the inner wall of the mold 1. But this oscillation leaves oscillation marks on the solidifying shell 7 and causes other surface defects by entrapping the powder 18 therein.

There are some conventional continuous-caster molds that have ceramics and other materials of low heat conductivity affixed to the inner wall thereof. For example, molds 1 proposed in Japanese Provisional Patent Publications Nos. 173061 of 1983 and 195742 of 1986 have such materials affixed from the upper end to the lower end or middle thereof, including the point where solidification of molten metal starts, with a view to slowly cooling the molten metal 5 or the solidifying shell 7. Also, Japanese Provisional Patent Publication No. 13445 of 1983 proposes a mold 1 which has such wean-resistant materials as ceramics and stainless steel affixed to the inner wall thereof, including the vicinity of the lower end thereof, in order to prolong the mold life.

In the molds proposed in Japanese Provisional Patent Publication Nos. 173061 of 1983 and 195742 of 19086, solidification starts at the surface of the molten metal. Therefore, the need for the powder 18 and, as a consequence, the problems of oscillation marks and powder entrapment remain unremoved. On the other hand, the wear-resistant materials disclosed in Japanese Provisional Patent Publication No. 13445 of 1983, which are used to protect the lower end of the molds used in atmospheres of very high temperatures, have no effect on the solidification of the poured molten metal. Accordingly, the problems of oscillation marks and powder entrapment again remain unsolved.

For the affixing of ceramics to the surface of other substance, Japanese Provisional Patent Publication No. 93474 of 1989 discloses a method in which a layer of fine particles or fine powder of substances, which are strongly reactive and adhesive to ceramics and the substance to which the ceramics are affixed and whose particle size is smaller than the roughness of the surfaces to be joined together, and whose thickness is larger than the surface roughness, is inserted between them, with adhesion accomplished by subsequent application of pressure and heat. Japanese Provisional Patent Publication No. 120579 of 1983 discloses a method of joining such inorganic substances as ceramics and glass to such metals as platinum and copper. In this method, a paste containing 20 to 80 percent by weight of a powder of the inorganic material and 80 to 20 percent by weight of a powder of the metal to be joined together is applied to both materials which are then joined together by the application of heat.

But the conventional joining methods involving the application of pressure and heat are unsuitable for use on continuous-caster molds because they are too large to assure uniform heating. In a mold in which metal and ceramics are joined together, the ceramics are in contact with molten metal and the metal with cooling water, whereby a temperature difference arises therebetween. Because there is a considerable difference between the coefficients of linear expansion of the metal, inorganic adhesive and ceramics, the inorganic adhesive that cannot absorbs thermal stress causes cracks and nicks at joint boundaries, during the casting operation in which the mold is repeatedly exposed to heat, thereby lowering the adhesive strength and creating a danger of peeling. Inorganic adhesives mixed with metal powder also involve the danger of cracking and peeling resulting from the difference in their coefficients of linear expansion. Conventional adhesives, in addition, do not have high enough heat conductivity to permit sufficient heat extraction between the mold and molten metal and, therefore, do not permit the formation of adequately thick and stable solidified shells. To prevent breakouts, as a consequence, it becomes necessary to lower the casting speed, which results in the lowering of productivity. If the thickness of the ceramics is reduced to achieve the extraction of a greater amount of heat, a decrease in mechanical strength and the shortening of mold life through wearing may result.

SUMMARY OF THE INVENTION

An object of this invention is to permit the production of high-quality casting by lining the inner wall of the mold with pieces of ceramics that function like a solid lubricant, with the thickness thereof varied in the direction in which the castings are withdrawn or in that direction and breadthwise, thereby eliminating the need for using lubricating powders.

Another object of this invention is to provide long-life ceramics-lined continuous-caster molds that are free from the lowering of adhesive strength, thermal stress absorption ability and poor heat conductivity that might occur when the ceramics-bonding adhesives used with conventional molds are heated.

In order to achieve the above objects, a continuous-caster molds according to this invention comprises inner walls of copper or copper alloys or inner walls of copper sprayed, plated or otherwise covered with other materials that are lined with ceramics whose thickness is varied either stepwise or progressively. The thickness of the lining is varied to prevent the formation of air gaps between the surface of the lining and the solidifying shell and the cool the steel being cast according to the desired pattern, and/or to start solidification of the molten metal below the molten metal surface level.

Friction in continuous-casting processes can be reduced by designing the uppermost ceramics lining, which comes in contact with the molten metal surface, so that solidification of the molten metal starts below the molten metal surface, with the inner wall of the mold tapered by considering the static pressure of the molten metal between the molten metal surface and the point of solidification.

In the continuous-caster mold according to this invention, the molten metal and solidifying shell are slowly cooled, so that the sticking of the solidifying shell to the mold wall is reduced. The friction-free continuous-caster mold according to this invention permits making castings of excellent surface quality without employing mold powders and mold oscillation. Because solidification starts below the molten metal surface, the solidifying shell is free of defects that have conventionally resulted from the surface level changes at the point where solidification begins. As such, casting can be performed with the mold directly connected to a tundish.

This invention also provides a mold lined with ceramics whose thickness is varied in the direction of casting and also made variable breadthwise (the direction perpendicular to the casting direction) and a continuous casting process that assures solidification of the liquid metal will start at the same level throughout the entire periphery of the mold by use of the mold just described.

This invention furthermore provides a mold having a continued internally curved heat-insulating zone and cooling zone in the upper part thereof and a continuous casting process that withdraws the shell formed by initial solidification of the molten metal with reduced friction by use of the mold just described.

Furthermore, the ceramics are bonded to the inner wall of the continuous-caster mold of this invention with organic adhesives mixed with metal powder or metal fibers. Also, the ceramics are affixed to the inner wall of the continuous-caster mold of this invention with organic adhesives, with metal wire netting interposed therebetween. The organic adhesives used with the molds of this invention are of epoxy, silicone, phenol and other similar resins that withstand heat of from 70° to 260° C. Also, surface irregularities are provided on the surface of the molds of copper or copper alloys that are bonded to the ceramics with organic adhesives alone or mixed with metals, with the projecting portions of the irregularities held in contact with or in the vicinity of the ceramics.

While the ceramics lining securely affixed to the inner wall of the continuous-caster molds of this invention gives longer service life, the excellent heat extraction characteristic permits high-speed casting just like the conventional molds. In addition, the ceramics lined over the mold wall provide self-lubrication.

DESCRIPTION OF THE PREFERRED EMBODIMENTS

Figure 2:
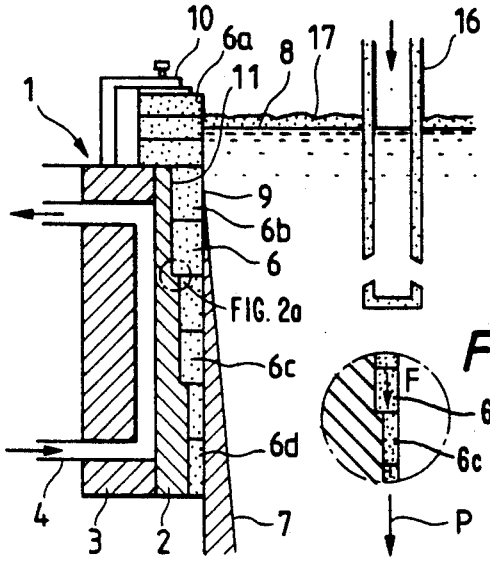
FIGS. 2 and 2*a* is a vertical cross-sectional view showing a continuous-caster mold according to this invention.

FIG. 2 shows a continuous-caster mold 1 according to this invention which has an inner wall 2 fabricated from copper having good heat conductivity and a cooling box 3 provided therebehind. The cooling box 3 incorporates cooling water passages 4 to pass cooling water that cools and solidifies the molten metal 5 poured into the mold 1. To the inner wall 2 are affixed ceramic tiles 6*b* to 6*d* whose thickness is varied in the direction in which the metal being cast is withdrawn, which is indicated by arrow P, thus making up an inner lining 6. Ceramics blocks 6*a* having a greater thickness than the tiles are provided on top of the tiles and entend over the top of the inner wall 2 to serve as a heat-insulating layer. The inner wall 2 may also be either made of either a copper alloy or covered with a layer of an alloy of chromium, nickel or other metals.

The ceramics are made from such materials as boron nitride (BN) and silicon nitride ($Si_3N_4$) that have resistance to abrasive wear, heat and thermal shock, heat conductivity and lubricating property. Lining the inner wall 2 with the ceramic tiles 6*b* to 6*d* prevents the sticking of the solidifying shell 7, which forms when the molten metal 5 solidifies, to the surface of the inner wall 2 or the risk of more serious breakouts in which the inner molten metal flows out through the ruptured shell. Elimination of the need for using lubricating powders between the inner wall and the solidifying shell 7 prevents the entrapment of powders due to molten-metal level variations and the occurrence of other surface defects. Although lubricating powders are unnecessary in operation, a molten-metal surface heat insulator 17 is used to provide the heat insulation and the maintenance of temperature required by the molten metal 5 poured from a pouring nozzle 16.

The ceramic tiles 6*b* to 6*d* affixed to the inner wall 2 are so smooth-surfaced that the castings are withdrawn smoothly. Consequently, the cast products have smooth, defect-free surfaces.

The ceramic tiles 6*b* to 6*d* affixed to the inner side of the inner wall 2 keep the molten metal 5 out of direct contact with the inner wall 2, while serving as a heat-insulating layer that permits the molten metal 5 or the solidifying shell 7 to cool slowly. Therefore, the shrinkage which the solidifying shell 7 has undergone in the mold 1 is made up for by creep. Protected from rapid cooling and solidification, the solidifying shell 7 does not shrink to such an extent as to form air gaps. This results in a solidified shell of uniform thickness which, in turn, permits high-speed withdrawing.

Figure 3:
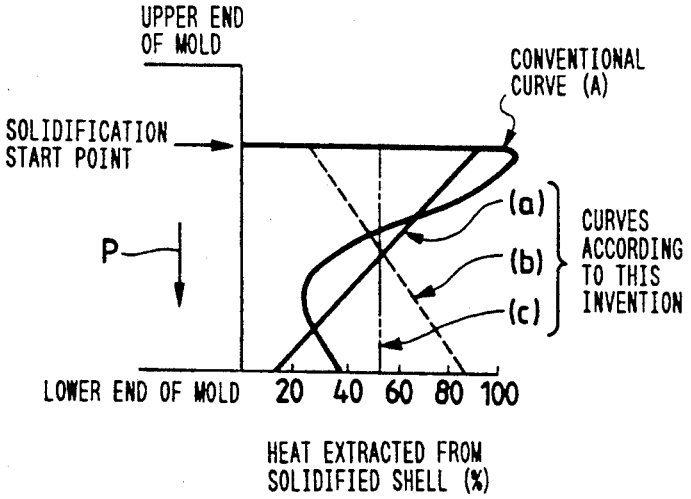
FIG. 3 graphically shows how the heat extraction through the mold shown in FIG. 2 changes in the direction of casting, compared with that of a conventional mold.

The amount of heat transfer through the inner wall of the continuous-caster mold 1 lined with the ceramic tiles 6*b* to 6*d* changes in the casting direction P, as shown in FIG. 3. Heat extraction at the top of the mold 1 where the thick ceramics blocks 6*a* are provided is practically negligible. Heat extraction can be varied by changing the thickness of the ceramics 6*a* to 6*d* according to the requirement of individual operations.

Curve (a) in FIG. 3 shows a heat extraction curve for a plain carbon steel that is attained by changing the thickness of the ceramics liners 6*a* to 6*d* so that the amount of heat extraction decreases progressively from the top in the initial solidifying stage. This heat extraction pattern is equivalent to the most common one in the conventional continuous casting with mold powders.

Curve (b) shows a heat extraction pattern for steels that are cast at slow speed with slow cooling, such as chromium-containing stainless steels and some other alloy steels. The thickness of the ceramic liners 6*a* to 6*d* is reduced in that order to provide increasingly greater heat extraction downward. Curve (c) shows a uniform heat extraction pattern that has proved effective for high-speed cast with slow cooling. The pattern according to curve (c) is obtained by varying the thickness of the ceramic tiles 6*b* to 6*d* downward from the top end of the mold so that uniform heat extraction is achieved throughout.

In all of the above patterns, solidification of the molten metal 5 poured into the continuous-caster mold 1 begins at a solidification starting point 9 below the molten metal surface 8. Preferably, the solidification starting point 9 should be at least 30 mm below the molten metal surface 8. If the distance is less than 30 mm, the molten metal may entrap the heat-insulating mold powder sprinkled over the surface of the molten metal. Also, the influence of the variation in the molten metal surface may make it difficult to achieve the solidification below the surface level, which leads to the formation of a defective solidifying shell containing layers mixed with the heat-insulating mold powder and containing high percentages of floating non-metallic inclusions. By assuring that solidification of the molten metal begins at a point at least 30 mm below the molten metal surface 8, the formed shell 7 has a stable surface quality without being influenced by surface level variations. Preferably, the casting operation should be carried out with a suitable heat extraction pattern and a corresponding lining taper that will provide the desired solidification and contraction for each individual type of steel.

The thickness of the solidifying shell 7 increases progressively as the rate of heat extraction changes through the continuous-caster mold 1 in the casting direction P, whereby the solidifying shell 7 is always in contact with the inner surface of the mold. In the conventional continuous casting with mold powders, powder feed is not always uniform but sometimes becomes interrupted, with the resulting localized heavy cooling causing the shrinkage of the solidifying shell and forming air gaps. This tendency becomes more pronounced toward the lower end of the continuous-caster mold 1. The mold of this invention, by contrast, always provides such an ideal condition similar to the one obtained in a uniformly powdered conventional mold that the solidifying shell 7 is kept out of direct contact with the inner wall 2 and, therefore, always fits the inner profile of the mold.

The thickness of the ceramics is increased in the upper part of the continuous-caster mold 1 that is exposed to high temperatures and decreased in the lower part where the surface temperature becomes relatively lower. This arrangement permits keeping the temperature on the mold wall side of the ceramic tiles 6*b* to 6*d* at a relatively low level. As a consequence, the adhesive that bonds together the inner wall 2 and the ceramic tiles 6*b* to 6*d* is not exposed to high temperatures that might cause its deterioration.

Figure 1:
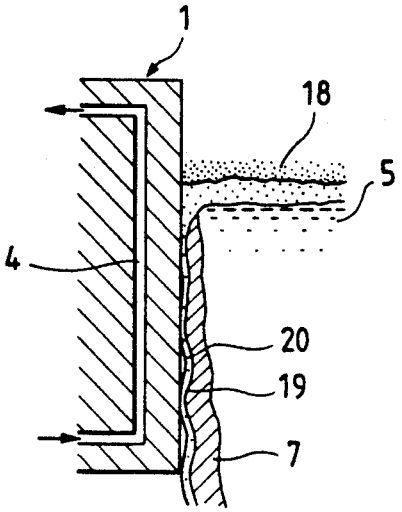
FIG. 1 PRIOR ART
FIG. 1 is a sectional view showing the condition of metal being cast in a conventional continuous-caster mold.

Heat extraction in the conventional mold, in contrast, changes as indicated by the S-shaped curve A in FIG. 3 because of the formation of air gaps. The molten metal 5 is cooled immediately below the molten metal surface 8, forming a solidifying shell 7. The solidifying shell 7 that forms and grows too rapidly tends to form an air gap between itself and the inner wall of the continuous-caster mold 1 as illustrated in FIG. 1. This results in a sharp reduction in heat extraction. Though the air gap can be made smaller by increasing the withdrawal speed of the casting, but the withdrawal speed should not be increased beyond a certain limit because of the risk of breaking the powder film and increasing the frictional resistance.

In the continuous-caster mold 1 lined with the ceramic tiles 6*b* to 6*d*, the molten metal 5 and the solidifying shell 7 are slowly cooled, which results in castings having good surface quality. Because the ceramic tiles 6*b* to 6*d* allow the solidifying shell 7 to move forward smoothly, the casting is smoothly withdrawn from the continuous-caster mold 1 without using any powder or other lubricants. The obtained castings are free of surface defects that might result from the entrapment of powders and oscillation marks. Very clean castings having stable surface properties can be obtained because the formation of the solidifying shell 7 begins at a point below the molten metal surface 8 that is unaffected by any changes at the surface level.

Figure 2A:
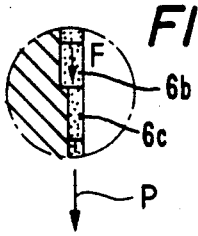

The ceramics block 6a mounted on top of the continuous-caster mold 1 and the ceramic tiles 6b to 6d lined over the inner wall 2 are fastened as shown in FIG. 2. The uppermost ceramic block 6a is pressed against the top surface of the inner wall 2 by means of a clamp 10. The ceramic tiles 6b to 6d are bonded to the front surface of the inner wall 2 with a ceramic-type adhesive 11. Here, there is the risk that the ceramics tiles 6b to 6d may slip downward under the influence of frictional force F that arises between the solidifying shell 7 and the inner surface of the mold when the casting is withdrawn downward. But this risk can be avoided by providing steps on the inner wall 2 to support the lower ends of the ceramic tiles 6b to 6d as illustrated in FIG. 2a.

The molten metal superheated to a temperature 20° to 50° C. above the liquidus temperature is usually poured into the mold at a temperature 5° to 30° C. above the liquidus temperature. The ceramic block 6a on top of the continuous-caster mold 1 functions as a heat-insulating layer that prevents the escape of heat from the molten metal so that the solidification thereof begins below the molten metal surface. Assuming that the temperature of the molten metal in the mold is 5° to 30° C. above the liquidus temperature, therefore, the heat-insulating layer of the ceramic block 6a should preferably have a thickness of 30 to 300 mm, though this value varies with the heat conductivity of the ceramic.

The casting having a square cross section like a bloom is cooled more strongly in the proximity of the corners of the mold than elsewhere. In a mold in which such overcooled areas exist, metals that tend to solidify and shrink heavily, like peritectic steels ((C)=0.08 to 0.14%), form an air gap between the inner wall of the mold and the casting when it solidifies and shrinks as a result of overcooling. This results in an increase in the resistance to heat extraction and the blocking of shell growth. Then, the solidified shell re-melts and ruptures, with the molten metal inside blowing outside to cause surface defects known as bleeding marks in the proximity of the corners of the cast strand. But the air gap resulting from over-cooling can be prevented by using thicker ceramics at the corners of the mold than in the middle portion thereof. The casting having a rectangular cross section like a slab is cooled more strongly in the proximity of ends of the broad face (close to the narrow face) of the mold than in the middle thereof. As a consequence, solidification starts at different depths below the molten metal surface along the broad face of the mold. But this irregularity in the starting point of solidification can be smoothed out around the periphery of the mold by using thicker ceramics in the proximity of ends of the broad face than in the middle portion thereof as in the case of the bloom. By so doing, bleeding marks, cavities and other surface defects resulting from overcooling can be prevented. To prevent the occurrence of such surface defects, the difference in the thickness of ceramics should preferably be between 0.3 and 3.0 mm, though this range varies with the cooling capacity of the mold, the condition of the metal flow in the mold and other factors. If the thickness difference exceeds 3.0 mm, the cooling rate will become so slow that the solidifying shell fails to grow fast enough to attain adequate strength to prevent skin ruptures. If the thickness difference is under 0.3 mm, on the other hand, it will become impossible to prevent the occurrence of bleeding marks, cavities and other surface defects.

Figure 17:
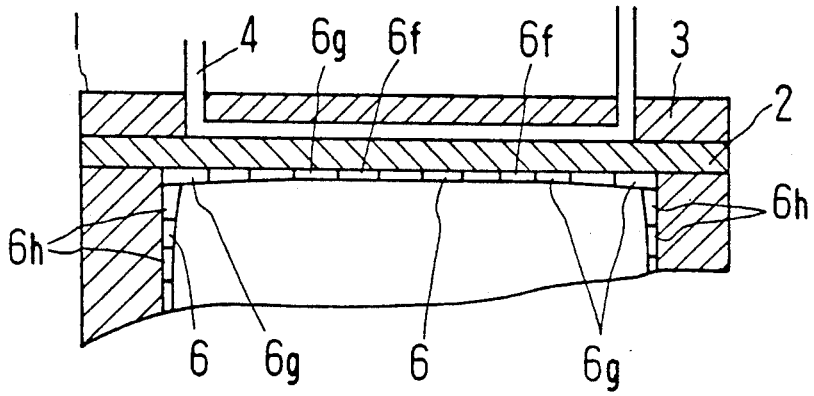
FIG. 17 is a cross-sectional view of a mold that is lined with thicker ceramic in the proximity of the ends of the broad face than in the middle portion thereof.

FIG. 17 shows a preferred embodiment that is lined with thicker ceramic in the proximity of the ends of the broad face than in the middle portion thereof. The ceramic tiles 6f affixed to the middle portion of the inner wall 2 of the mold are thinner than the ceramic tiles 6g and 6h in the proximity of the ends of the inner wall 2.

Figure 4:
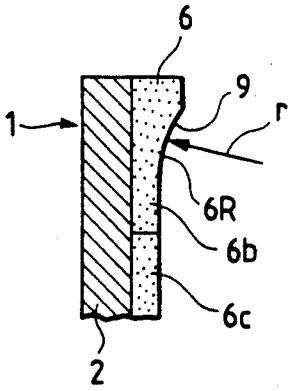
FIG. 4 is a partial vertical cross-sectional view of a mold according to this invention showing a curved portion of the inner wall thereof.

The solidifying shell is pressed against the ceramics lining by the static pressure of the molten metal. Therefore, a frictional force arises between the cast strand and the ceramic lining when the strand is withdrawn from the mold. On the other hand, the thickness of the solidifying shell is still thin in the initial solidification region immediately below the point where solidification begins. To prevent the breaking of the cast strand by the withdrawing force, it is necessary to reduce the frictional force by ensuring that solidification proceeds in such a manner that the surface of the shell and the ceramic lining are softly in contact with each other. Such a condition can be attained by forming a curve portion 6R on the ceramic lining 6 throughout the entire periphery of the mold, as shown in FIG. 4, with the curved portion 6R containing the solidification starting point 9, having and the arc extending in the withdrawing direction and the angle defined by the top and bottom ends of the arc limited to 90 degrees or less. The strand withdrawing force exerts a component of force acting in the direction of the radius of curvature of the curved portion 6R or a force to pull the solidifying shell away from the surface of the mold lining against the static pressure of the molten metal. This reduces the frictional force that works on the shell during the initial stage of solidification. This permits carrying out a smooth casting within the limit in which the initially formed solidifying shell remains unruptured. The radius of curvature r of the curved portion 6R should preferably be between 30 and 300 mm. If the radius of curvature is under 30 mm, the amount of the heat extracted decreases as the withdrawal proceeds, which can result in re-melting and double solidification. Also, the region in which the frictional force does not work decreases to lessen the effect of the reduced frictional force. If the radius of curvature r exceeds 300 mm, in contrast, the static pressure of the molten metal keeps the solidifying shell pressed against the surface of the mold lining, thereby nullifying the effect of the reduced frictional force. This can lead to skin ruptures and breakout.

Figure 5:
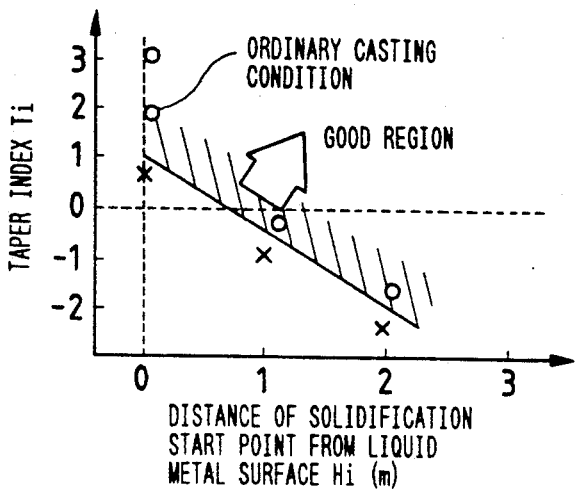
FIG. 5 graphically shows the relationship between the static pressure of molten steel and the mold taper.
Figure 7:
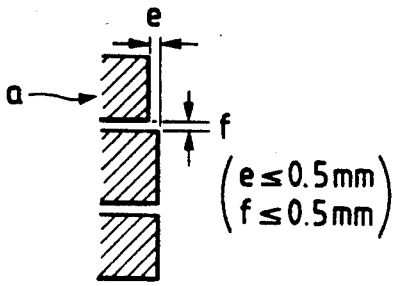
FIG. 7 shows the telerable smoothness of the joint area.

To ensure that the solidifying shell 7, which begins to form at the point 9 below the molten metal surface 8, moves forward smoothly over the ceramic tiles 6b to 6d, it is preferable to appropriately taper the inner surface (facing the inside of the mold) of the ceramic tiles 6b to 6d with respect to a vertical line. FIG. 5 shows an appropriate pattern chosen by considering the influence of the static pressure of the molten metal on the solidification below the molten metal surface. If $H_1$ is the distance between the solidification starting point 9 and the molten metal surface 8 (i.e. the thickness of molten metal layer) and $T_1$ is the index of taper on the inner surface of the mold between the upper and lower ends of the mold (derived by dividing the difference between the clearance at the top and the clearance at the bottom by 2, compared with the base figure of 0 that is obtained when the mold wall is vertical), the optimum relationship between $H_1$ and $T_1$ from the viewpoint of friction is obtained in the hatched region. When the index of distance $H_1$ is large and the molten metal exerts a great molten metal static pressure, the index of taper $T_1$ should be increased on the negative side to expand the inner surface of the mold downward. When the index of distance $H_1$ is small, the index of taper $T_1$ should be increased on the positive side to expand the inner surface of the mold upward to promote the growth of the solidifying shell 7. During the initial stage of solidification in which the shell is not yet strong enough, care should be taken to avoid skin ruptures. Provision of a taper corresponding to the amount of creep deformation (bulging) which the solidifying shell 7 undergoes under the influence of the static pressure of the molten metal in the casting direction P without impairing the cooling condition reduces the friction due to the static pressure of the molten metal. When the continuous-caster mold 1 is directly connected to the tundish as described later, provision of a taper holds down an increase in the friction caused by the static pressure of the molten metal, too. This taper adjustment reduces the frictional resistance of the continuous-caster mold 1, thereby permitting high-speed casting in spite of solid lubrication.

When the distance between the molten metal surface and the solidification starting point is 30 mm or above, the taper index $T_1$ should preferably be kept between $-2.0$ and $+1.8$, more preferably between $-1.5$ and $+1.0$. If the taper index $T_1$ is smaller than $-2.0$, the inner surface of the mold is kept out of contact with the solidifying shell that deforms (through creeping and bulging) under the influence of the static pressure of the molten metal, whereby the mold loses its ability to support the solidifying shell and extract heat therefrom. When taper index $T_1$ exceeds $+1.8$, the frictional force between the inner surface of the mold and the solidifying shell increases, with a resulting increase in mold wear and decrease in mold life. The solidifying shell then becomes more susceptible to constraint by the inner surface of the mold and breakouts an cannot be formed by high-speed casting.

A taper having an appropriate angle with respect to horizontal lie n is provided on the inner surface of the mold used for horizontal continuous casting.

As shown in FIG. 2, the ceramic tiles **6*b* to 6*d* are attached to the inner wall of the continuous-caster mold 1. A one-piece ceramic lining, like the break ring of horizontal continuous casters, may be provided on the continuous-caster mold 1. But such larger ceramic lining involves various limitations on making, installation and use. For the mold of vertical continuous casters, therefore, it is preferable to use a lining consisting of smaller tiles as shown in FIGS. 6**(*a*) and (*b*). FIG. 6 (*a*) shows a width-adjustable mold and FIG. 6(*b*) shows a fixed-width mold. In either mold, small-sized ceramic tiles are provided in a zigzag pattern on the inner side of the mold wall 2 and make up an inner lining on the broad face **1*a* and the narrow face 1*b***. While conventional mold powders cannot provide uniform lubrication throughout, with the overall powder-mold contact ratio standing at about 50 percent at best, the tile lining assures very good heat extraction.

Figure 6A:
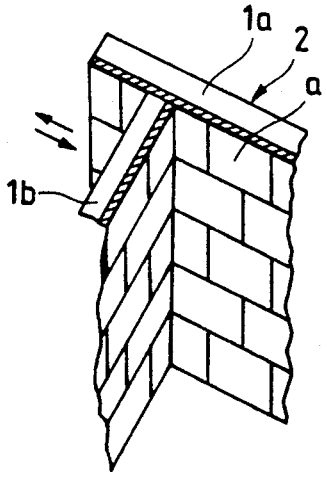
FIGS. 6(*a*) and (*b*) are perspective views showing the conditions of ceramics affixed to the inner wall of copper molds.
Figure 6B:
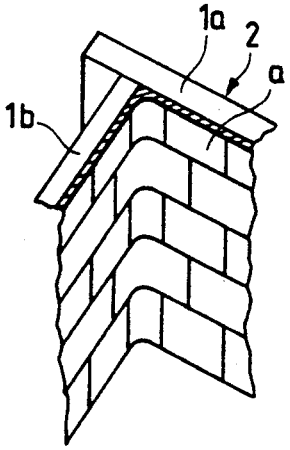

With the ceramic tiles a arranged in an irregular pattern, for example, a running bond pattern as shown in FIGS. 6A and 6B, the surface irregularities of the joints between the individual tiles may seem to offer an obstacle to the formation of the solidifying shell. It has been experimentally proved, however, that sound shells can be formed smoothly if the horizontal distance e and the thickness f of the joint f between adjoining ceramics tiles a are kept at 0.5 mm or under. The joint thickness f not larger than 0.5 mm prevents the penetration of the molten metal between the ceramic tiles. It is also preferable to keep the joint thickness f at 0.1 mm or under where the ceramic tiles are in contact with the molten metal.

The preferable size of the ceramic tiles is between 20 and 300 mm in both width and length. Tiles smaller than 20 mm in width and length result in more joints per unit area, which, in turn, increases the frictional resistance between the inner surface of the tile-lined mold and the steel being cast, decreases the heat which can be extracted, and adds complexity to the lining work. If the width or length exceeds 300 mm, it becomes difficult to affix ceramic tiles to the inner wall of the mold with a uniform adhesive force. When thermal stresses are built up by repeated heating and cooling, some of the ceramic tiles will come off the inner wall of the mold, thereby shortening the service life of the mold. Limiting the size of the ceramic tiles within the above range facilitates keeping the joint thicknesses f at not wider than 0.5 mm or more preferably 0.1 mm.

Figure 8:
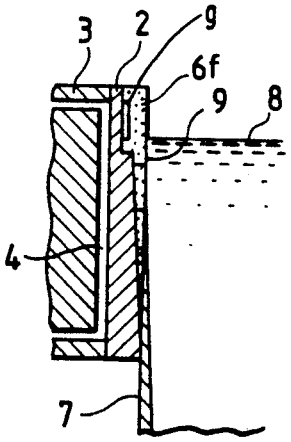
FIG. 8 is a vertical cross-sectional view showing a continuous-caster mold lined with pieces of ceramics.

But the arrangement of the ceramic tiles is not limited to the one described above. For example, a smaller piece of ceramic **6*f* may be affixed to the inner wall of the continuous-caster mold 1 as shown in FIG. 8. The portion of this ceramic piece 6*f* in the proximity of the molten metal surface 8** is thicker than the lower part whose thickness is progressively decreased downward. When the thickness of the inner lining is stepwise varied, it is preferable to change it in three or more steps.

The thicker portion that comes in contact with the molten metal 5 near the surface 8 thereof permits solidification of the molten metal to start at a point 9 below the molten metal surface 8. A mold that thus permits the molten metal to solidify below the surface thereof can be directly connected to the tundish.

A clearance g can be provided between the ceramic tile **6*f* and the inner wall 2 in the proximity of the molten metal surface as shown in FIG. 8**, thereby permitting effective heat insulation and facilitating the solidification of liquid steel below the surface level thereof.

Figure 9A:
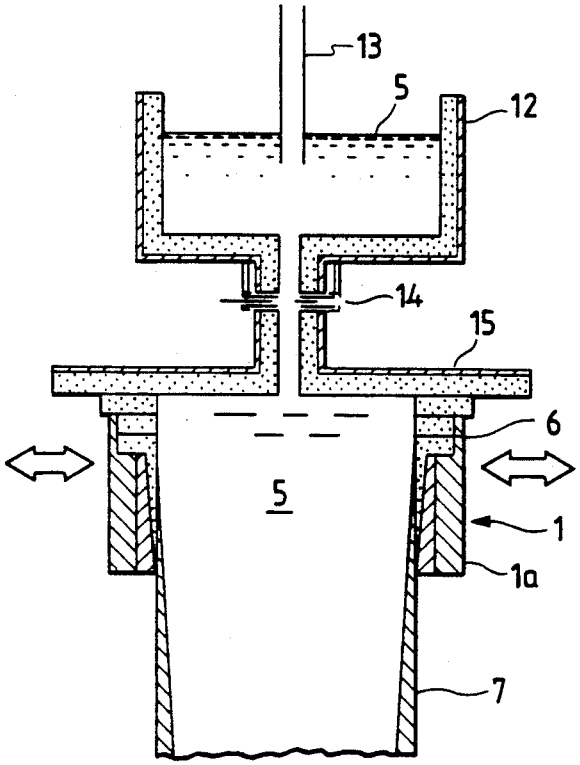
FIGS. 9(*a*) and (*b*) are vertical cross-sectional views showing continuous-caster molds directly connected to a tundish viewed from the broad mold face side and the narrow mold face side, respectively.
Figure 9B:
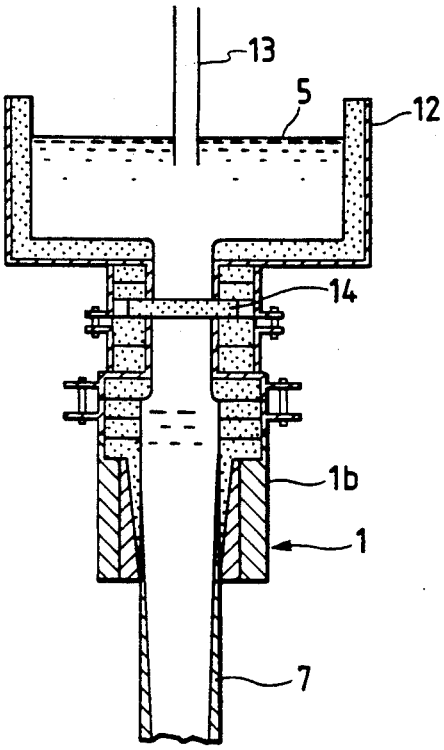

FIGS. 9(*a*) and (*b*) show equipment arrangements including the continuous-caster mold of the type described above. The molten metal 5 fed into a tundish 12 through a long nozzle 13 is then poured into a continuous-caster mold 1 through a sliding nozzle 14 provided in the bottom wall of the tundish 12.

An arrangement shown in FIG. 9(*a*) has a width-adjustable mold 1 suited for use, for example, in slab casting. Because the tundish 12 and the mold 1 are directly connected, the top of the mold 1 is not left open as in the conventional practices but closed with a cover 15. It is possible to slide the walls of the mold 1 in the directions of the arrows in which the narrow mold faces **1*a* are positioned perpendicular to the cover 15. Highly lubricating ceramics 6 provided in the upper portion of the mold 1 assure a smooth slide of the mold 1 with respect to the cover 15**.

The arrangement shown in FIG. 9(*b*) has a fixed-width continuous-caster mold 1 suited for use, for example, in bloom casting. The mold 1 and tundish 12 are connected with a large or equal-sized opening to pour the molten metal to assure smooth casting without nozzle clogging and other hitches.

When the solidifying shell 7 is thus formed without exposing the molten metal 5 to the atmosphere, the problem of oxidation at the molten metal surface is completely solved. By choosing an appropriate opening of the sliding nozzle 14, the static pressure of the molten metal 5 in the continuous-caster mold 1 is controlled to eliminate the risk of breakouts and other defects. It is also possible to control the molten metal static pressure by applying an upward driving force to the stream of molten metal flowing through the sliding nozzle 14 by means of a magnetic coil provided around the sliding nozzle 14.

In the conventional continuous casting process, by contrast, the molten metal is poured through the nozzle in the bottom of the tundish 12 into the copper-lined mold 1 where it is cooled and solidified. Accordingly, solidification of the molten metal begins at the molten metal surface and powders are used to lubricate the interface between the copper lining and the solidifying shell. And these factors lead to various serious quality and operational problems, such as the entrapment of powders and aluminum-oxide-type inclusions, pinholes and blowholes due to the entrapment of sealing argon gas from the detachable immersion nozzle and air, and nozzle clogging.

To avoid these problems, it is necessary (1) not to use mold powders, (2) not to start solidification of the molten metal at the surface level, (3) to use a continuous caster having a vertical section of 2.5 mm or longer to promote the flotation of inclusions, and (4) to use a large-diameter pouring tube in place of a common immersion nozzle. Such drastic improvements can be effectively achieved by directly connecting the tundish and mold.

Direct connection of the tundish and mold simplifies the casting operation and permits fully automatic casting and great labor saving because it reduces many difficult controls such as those of the pouring rate, molten metal surface and powder addition. The use of a large-diameter pouring tube in place of an immersion nozzle prevents conventional defects due to the formation of inclusions by the powder and slag in the mold. The large opening between the tundish and mold prevents nozzle colgging, permits casting at low temperatures, and greatly cuts down refractories consumption and production costs through the improvement of segregation and the use of lower-temperature molten metal. Direction connection of the tundish and mold permits providing a vertical section to a curved continuous caster, as a consequence of which the caster functions like a curved caster with a vertical section. As described above, this invention provides many beneficial effects.

EXAMPLE 1

Continuous casting was performed using a continuous-caster mold 1 of the type shown in FIG. 2 that had ceramic tiles **6*b* to 6*d* affixed to the front side of the inner wall 2 thereof. The thickness of the ceramics tiles 6*b* to 6*d* was adjusted so that intense cooling in the upper part (indicated by curve (a) in FIG. 3), subdued cooling in the upper part (indicated by curve (b) in FIG. 3) and uniform cooling (indicated by curve (c) in FIG. 3) could be achieved. For the purpose of comparison, continuous-casting was also performed using a conventional mold without a ceramic lining. The cooling pattern in the compared example was an S-shaped curve (indicated by curve (A) in FIG. 3). By pouring molten plain carbon steel, which had a temperature of 1540° C. in the tundish, into the individual molds, sections (slabs and blooms) were cast at a speed of 0.6 to 1.2 m per minute. The obtained results are shown in Table 1. Using the temperature of the copper lining determined by thermocouples, simulation was made by the finite element method. Then, the point of molten metal solidification 9 was found to be 50 to 80 mm below the molten metal surface 8**.

TABLE 1

| | Embodiments of This Invention | | | | Compared Conventional Molds | |
|---|---|---|---|---|---|---|
| Description | a | b | c | d | X | Y |
| Size of Mold Frame (mm) | 290 sq. | 250 × 980 | 250 sq. | 250 × 980 | 250 × 980 | 290 sq. |
| Size of Ceramics Piece (mm) | 40 × 80 | 150 × 300 | 100 × 200 | 150 × 300 | — | — |
| Thickness of Ceramics Piece at Different Parts of Mold Height (mm) | | | | | | |
| Top End | — | — | — | — | — | — |
| Upper Part | *15 | *15 | *15 | *20 | Ni—Cr plated | Ni—Cr plated |
| Middle Part | 7 | 10 | 9 | 10 | " | " |
| Lower Part | 10 | 7 | 8 | 7 | " | " |
| Type of Cast Steel | Al—Si—K | L(C)Al—K | Al—Si—K | Peritectic steel (C) = 0.10% Al—Si—K | Peritectic steel (C) = 0.09% Al—Si—K | Peritectic steel (C) = 0.10% Al—Si—K |
| Mold Oscillation | Applied | Applied | Not applied | Not applied | Applied | Applied |
| Casting Speed (m/min) | 0.6 | 1.2 | 0.7 | 1.0 | 1.2 | 0.9 |
| Cooling Pattern | Upper part intense cooling | Upper part subdued cooling | Uniform cooling | Upper part subdued cooling | S-curve cooling | S-curve cooling |
| Mold Powder | Not used | Not used | Not used | Not used | Used | Used |
| Mold Superheating Temperature (°C.) | 15 | 16 | 17 | 15 | 14 | 15 |
| Evaluation | | | | | | |
| Surface Condition | Good | Good | Good | Fine bleeding marks at corners | Many bleeding marks | Many bleeding marks |
| Oscillation Mark | None | None | None | None | Pronounced | Pronounced |
| Overall | ⊚ | ⊚ | ⊚ | ○ | x | x |

In the mold used in this example, an opening of 1 to 2 mm was left between the front side of the mold inner wall 2 and the upper ceramic tile **6*b* in order to suppress the transfer of heat from the molten metal to the inner wall. The asterisks in Table 1 indicate the provision of the opening. Provision of this opening permits attaining a great heat-insulating effect and achieving solidification of the molten metal below the surface level even when the thickness of the ceramic tile 6***b* is reduced. With the mold used in this example, the ceramic blocks 6*a* were not mounted on top of the inner wall 2.

In the operation according to this invention shown in Table 1, continuous casting was achieved without sprinkling mold powders on the molten metal surface, and solidification of the molten metal started below the surface level. Bleeding marks decreased even without mold oscillation, and even with peritectic steels. But high-speed casting can be achieved if mold oscillation is casting can be achieved if mold oscillation is employed.

Castings having good surface quality were also obtained when molten metal was poured into the continuous-caster mold 1 from the tundish 12 directly connected thereto as shown in FIG. 9(*b*). Kept out of contact with the atmosphere, the molten metal flowing down from the tundish 12 is as clean as when it was poured into the tundish 12, with its internal structure free from entrapped oxides.

EXAMPLE 2

Continuous casting was performed using a continuous-caster mold 1 of the type shown in FIG. 2 that had a BN ceramic block 6*a* pressed and fastened to the top of the mold 1 by a clamp 10. The tiles 6*b* to 6*d* affixed to the front side of the inner wall 2 were of BN ceramics.

Sections were continuously cast by pouring molten metal having a composition of plain carbon steel into the mold 1 as in Example 1. The obtained results are shown in Table 2. Using the temperature of the copper lining determined by thermocouples, simulation was made by the finite element method. Then, the point of molten metal solidification 9 was found to be 40 to 70 mm below the molten metal surface 8.

tion of a heat-insulating zone surrounded by the ceramic blocks and a cooling zone lined with ceramic tiles 6*b* to 6*d* kept the molten metal in the upper part of the mold molten, with solidification of the molten metal allowed to start below the molten metal surface 8 in the cooling zone.

EXAMPLE 3

Methods of affixing pieces of ceramics (hereinafter called ceramic tiles for simplicity) to the inner wall of the continuous-caster mold will be described in the following.

With the continuous-caster molds according to this invention, organic adhesives of epoxy, silicone and phenol resins, which permit bonding at ordinary temperature and have high buffer capacities to absorb thermal stress, are used. But they can not withstand temperature higher than 260° C. Also, their heat conductivities are lower than those of inorganic adhesives. While one side of the mold is exposed to high temperature (of molten metal), the other side thereof is kept at ordinary temperature (by cooling water). Under such condition, the temperature gradient in the bonding layer becomes steep and exceeds 260° C. on the high temperature side. Therefore, adhesives of the above type have conventionally been found to be unsuitable for use in the bonding of ceramic tiles to the continuous-caster mold.

In this example, therefore, metal powder was added to the organic adhesives. This addition improved heat conductivity, made the temperature gradient gentler, and brought the temperature of the bonding layer into the tolerable temperature range, thereby maintaining the original adhesive strength and enhancing the heat extraction characteristic.

Powder of such high heat-conductivity metals as gold, silver, copper, aluminum and iron is suited for addition. The higher the heat conductivity, the greater

TABLE 2

| Description | Embodiments of This Invention | | | | Compared Conventional Molds | |
|---|---|---|---|---|---|---|
| | E | F | G | H | X | Y |
| Size of Mold Frame (mm) | 290 sq. | 250 × 980 | 250 sq. | 250 × 980 | 250 × 980 | 290 sq. |
| Size of Ceramics Piece (mm) | 40 × 80 | 150 × 300 | 150 × 300<br>100 × 200 | 150 × 300<br>100 × 200 | — | — |
| Thickness of Ceramics Piece at Different Parts of Mold Height (mm) | | | | | | |
| Top End | 120 | 120 | 120 | 120 | None | None |
| Upper Part | 15 | 15 | 15 | 20 | Ni—Cr plated | Ni—Cr plated |
| Middle Part | 9 | 7 | 7 | 10 | " | " |
| Lower Part | 8 | 10 | 10 | 7 | " | " |
| Type of Cast Steel | Al—Si—K | L(C)Al—K | Al—Si—K | Peritectic steel (C) = 0.10% Al—Si—K | Peritectic steel (C) = 0.09% Al—Si—K | Peritectic steel (C) = 0.10% Al—Si—K |
| Mold Oscillation | Applied | Applied | Not applied | Not applied | Applied | Applied |
| Casting Speed (m/min) | 0.6 | 1.2 | 0.7 | 0.8 | 1.2 | 0.9 |
| Cooling Pattern | Uniform cooling | Upper part intense cooling | Upper part intense cooling | Upper part subdued cooling | S-curve cooling | S-curve cooling |
| Mold Powder | Not used | Not used | Not used | Not used | Used | Used |
| Mold Superheating Temperature (°C.) | 16 | 18 | 15 | 16 | 14 | 15 |
| Evaluation | | | | | | |
| Surface Condition | Good | Good | Good | Fine bleeding marks at corners | Many bleeding marks | Many bleeding marks |
| Oscillation Mark | None | None | None | None | Pronounced | Pronounced |
| Overall | ⊚ | ⊚ | ⊚ | ○ | X | X |

The mold used in this example had a 120 mm thick heat-insulating BN block 6*a* on top thereof. A combinawill be the improving effect. The amount of powder added affects heat conductivity, adhesive strength and the efficiency of kneading. When the amount of powder added exceeds 60 percent, heat conductivity increases but adhesive strength drops. When the amount is smaller than 10 percent, heat extraction becomes insufficient to raise the temperature to such a level as to lower the strength of organic adhesives. Therefore, the amount of metal powder added to the adhesives used on the continuous-caster mold should be kept between 10 and 60 percent by volume. Because the bonding layer is approximately 50 μm thick, the added powder must consist of spherical particles having a mean diameter of 10 μm, with a maximum diameter of 30 μm. Still, the shape of the metal powder particles is not limited to spherical, but may also be flaky and fibrous.

This type of organic adhesives with added metal powders can be used in bonding ceramic tiles to the metal wall of larger molds too because the conventional need of applying pressure or heat is avoided. When molten metal is poured, a temperature difference arises between both sides because the ceramic tiles are in contact with the molten metal and the metal plate with cooling water. But the organic adhesives with high buffer capacities absorb the thermal stress due to the difference in the coefficient of linear expansion between the metal plate and ceramic tiles. Therefore, the ceramic tiles do not crack or come off even when the mold is used repeatedly. As the organic adhesives absorb the expansion of the metal powders mixed therein, internal cracking can be prevented as well. The improved heat conductivity resulting from the addition of the metal powders permit extracting greater amounts of heat and, therefore, form a sufficiently thick, stable solidifying shell.

As described above, the addition of metal powders to organic adhesives used in the bonding of ceramic tiles to the inner wall of the mold has made it possible to use them under conventionally difficult conditions involving heavy thermal loads by taking advantage of the heat extraction achieved by the metal powders while absorbing thermal stresses by means of the buffer characteristics of the organic substances. Also, the elastic buffer capacity characteristic of the organic substances absorbs the thermal expansion of the metal powders that can lead to the breaking of the bonded joint. By solving such contradictory technical problems, it has now become possible to provide a lining of ceramic tiles is a continuous-caster mold.

Figure 10:
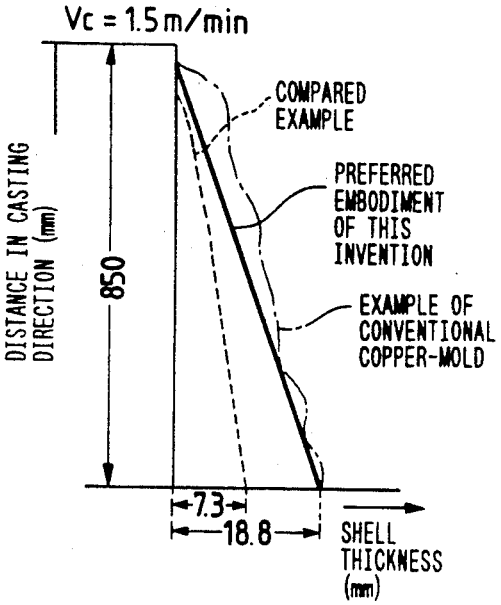
FIG. 10 graphically compares the thickness of the solidifying shell formed in a mold of this invention to the solidifying shell formed in a conventional mold.

A thermal analysis was carried out using a mold with an inner wall to which ceramic tiles were bonded with a silicone resin adhesive with 33 percent by volume of a metal powder added therefore (copper powder). As shown in FIG. 10, the same adhesive without the metal powder (the compared examples indicated by dotted line) was unusable because adequate heat extraction through the mold was unattainable. In the example in which the adhesive resin with the added metal powder was used (indicated by the solid line), by contrast, as much heat was extracted as was substantially comparable to the amount of heat extracted through the conventional molds without the lining of ceramic tiles (such as a conventional copper mold indicated by the dot-dash line).

Table 3 shows the results obtained in continuously casting blooms and slabs through the molds lined with ceramic tiles bonded with adhesives with added metals.

TABLE 3

| | Embodiments of This Invention | | | Compared Conventional Molds | |
|---|---|---|---|---|---|
| Description | I | J | K | X | Y |
| Size of Mold Frame (mm) | 290 sq. | 250 × 980 | 250 × 980 | 250 × 980 | 290 sq. |
| Size of Ceramics Piece (mm) | 150 × 300 | 150 × 300 | 150 × 300 | — | — |
| Thickness of Ceramics Piece at Different Parts of Mold Height (mm) | | | | | |
| Top End | 120 | 120 | 120 | None | None |
| Upper Part | 15 | 15 | 20 | Ni—Cr plated | Ni—Cr plated |
| Middle Part | 12 | 7 | 10 | " | " |
| Lower Part | 12 | 7 | 10 | " | " |
| Ceramics Bonding Conditions | | | | | |
| Addition of Metal Powder | 33% | 25% | 30% | — | — |
| Kind of Adhesive | Organic adhesive | Organic adhesive | Organic adhesive | — | — |
| Type of Cast Steel | Al—Si—K | L(C)Al—K | Peritectic steel (C) = 0.10% Al—Si—K | Peritectic steel (C) = 0.09% Al—Si—K | Peritectic steel (C) = 0.09% Al—Si—K |
| Mold Oscillation | Applied | Applied | Not applied | Applied | Applied |
| Casting Speed (m/min) | 0.6 | 1.2 | 0.8 | 1.2 | 0.9 |
| Mold Powder | Not used | Not used | Not used | Used | Used |
| Mold Superheating Temperature (°C.) | 12 | 13 | 13 | 14 | 15 |
| Evaluation | | | | | |
| Surface Condition | Good | Good | Good | Many bleeding marks | Many bleeding marks |
| Oscillation Mark | None | None | None | Pronounced | Pronounced |
| Peeling | None | None | None | — | — |
| Overall | ⊚ | ⊚ | ○ | x | x |

As is obvious from Table 3, the molds according to this invention shown under I to K gave rise to no surface defects, oscillation marks and spalling of tiles.

EXAMPLE 4

Another preferred embodiment in which ceramic tiles are affixed to the inner wall of the mold by another method will be described in the following. This method assures more uniform extraction of greater amounts of heat than in the embodiment using adhesives mixed with metal powder. This method also eliminates the difficulty of obtaining a homogeneous mixture when large quantities of metal powder are added to an adhesive even after much stirring and mixing.

This method bonds ceramic tiles to the front side of the inner wall of the mold with an organic adhesive, with a metal wire netting interposed between the tile and the inner wall.

The metal wire netting interposed between the copper lining and ceramic tiles are of gold, silver, copper, aluminum or iron, or alloys containing two or more of them, having wire diameters of 10 μm to 70 μm. The wire netting may be made up of vertical wires alone, horizontal wires alone, or both of them. The adhesive may contain powder of the same metal of which the wire netting is made.

In place of interposing the wire netting, surface irregularities may be provided on the ceramic tile side of the copper plate. Then, the ceramic tiles and copper plate are bonded together with an organic adhesive, with the projecting portion of the irregularly shaped copper plate held in contact with or in the vicinity of the ceramic tiles. Or otherwise, wire netting or metal powder of the type mentioned before may be provided in the openings left by the surface irregularities of the copper plate.

Figure 11:
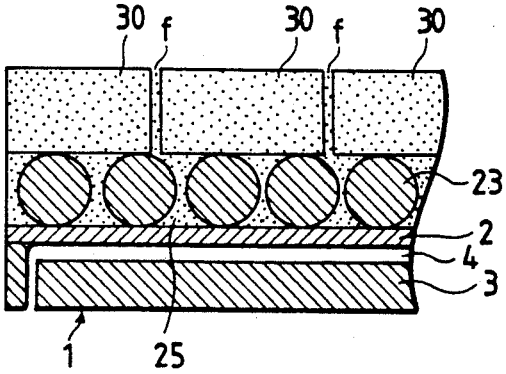
FIG. 11 is a partial cross-sectional view on an enlarged scale of a continuous-caster mold according to this invention.
Figure 12:
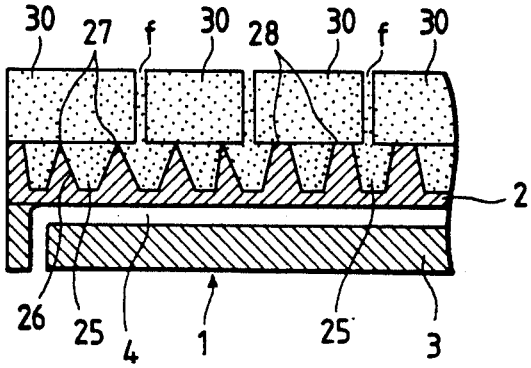
FIG. 12 is a partial cross-sectional view on an elarged scale of a continuous-caster mold according to this invention, in which copper plates having surface irregularities are used in place of the wire netting used in the embodiment shown in FIG. 11.
Figure 13A:
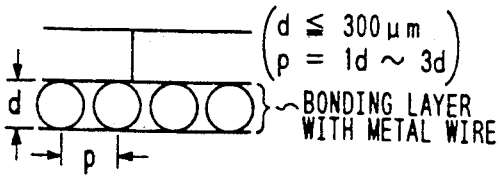
FIGS. 13(*a*)–(*f*) and 14(*a*)–(*f*) schematically illustrate the cross-sectional configuration and the planar appearance of the bonding layers shown in Table 4.
Figure 14A:
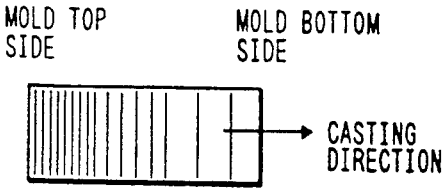
Figure 13B:
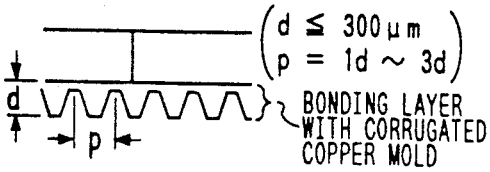
Figure 14B:
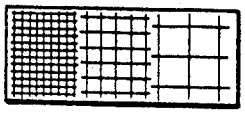
Figure 13C:
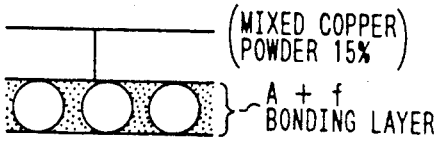
Figure 14C:
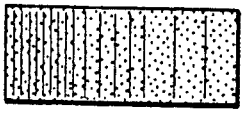
Figure 13D:
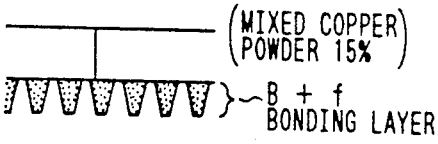
Figure 14D:
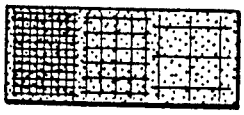
Figure 13E:
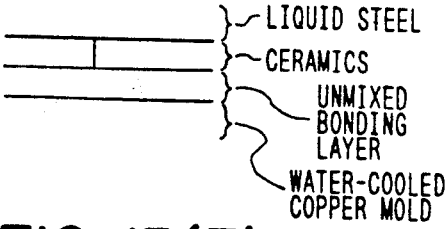
Figure 14E:
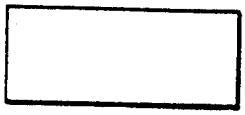
Figure 13F:
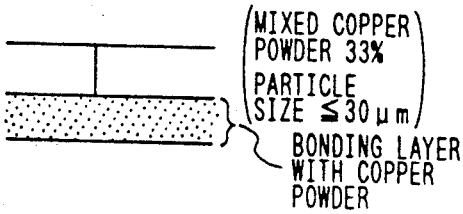
Figure 14F:
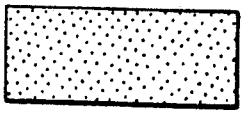

FIGS. 11 and 12 are schematic cross sections of the continuous caster molds of the type just described.

In FIG. 11, ceramic tiles 30 having a width and a length of 20 to 300 mm are placed over a metal wire netting 23 attached to the inner wall 2 that has a cooling water passage 4 therein, with the openings left therebetween filled with an organic adhesive 25. In FIG. 12, surface irregularities 26 are provided, in place of the metal wire netting, on the surface of the mold inner wall that come in contact with the ceramic tiles 30. With the projecting portion of the irregularly shaped mold wall kept in point contact, as indicated by reference numeral 27 at the left, or in plane contact, as indicated by reference numeral 28 at the right, with the ceramic tiles 30, the openings left between the inner wall 2 and ceramic tiles 30 are filled with an organic adhesive 25.

Metal powders, 10 to 60 percent in quantity, may be added to the organic adhesives used with the preferred embodiments shown in FIGS. 11 and 12.

Table 4 shows the performance of various types of bonding layers formed with organic adhesives evaluated under the molten metal loads applied in simulation tests (see also FIGS. 13 and 14).

A compared example designated as type e in Table 4 consists of an organic adhesive alone. The bonding layer formed on the continuous-caster mold is exposed to high temperatures (of molten steel) on one side and kept at ordinary temperature (by cooling water) on the other. Under such conditions, the temperature gradient in the bonding layer becomes very steep, as a result of which the interface temperature on the higher temperature side will exceed the tolerable limit of 260° C. Therefore, the adhesive of type e should not be used where the temperature exceeds the tolerable limit.

Type f is an organic adhesive with a metal powder added, which keeps the temperature of the bonding layer within the tolerable limit by making gentler the tempearture gradient therein through the enhancement of heat conductivity. This results in remarkably increased adhesive strength and heat extraction efficiency. But gas bubbles are likely to form during mixing. The gas bubbles inhibit heat extraction and uniform mixing of the metal powder. Therefore, the adhesive and metal powder must be mixed thoroughly.

Figure 15:
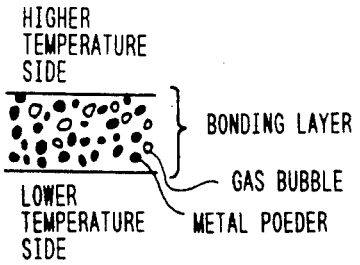
FIG. 15 is a schematic cross-sectional view of a bonding layer formed with an organic adhesive mixed with metal powder.

Type A in Table 4 has a heat transfer surface at higher temperature (on the ceramic tiles side) and a heat transfer surface at lower temperature (on the water-cooled copper plate side) that are kept in direct contact with metal wire that has good heat conductivity. Therefore, type A exhibits high heat conductivity and a good heat extraction characteristic. Because the temperature of the peripheral bonding layer is lowered, stable adhesive strength is obtained. The following paragraphs describe the characteristics of type A compared with those of type f. In the bonding layer of type f formed with an organic adhesive mixed with metal powder, heat conductivity can be enhanced by increasing the mixing ratio of metal powder. But addition of the metal powder should not be continued when kneading becomes difficult and too many gas bubbles are formed. Containing many heat transfer interfaces and gas bubbles as shown in FIG. 15 that lower heat conductivity, the bonding layer of type f transfers less heat than those of types A to D.

By contrast, type A permits good heat transfer because the higher and lower temperature sides are directly connected by the metal wire that has high thermal conductivity. Type B also produces good results

TABLE 4

(Adhesive: Organic silicone resin based)

| Description | Type | Cross-Sectional Configuration of Mold | Planar Appearance of bonded layer | Heat Extraction (Improvement in Heat Conductivity) | Adhesive Strength | Homogeneity of Bonded Layer | Remarks (Bonded Layer) |
|---|---|---|---|---|---|---|---|
| Embodiments of This Invention | A | FIG. 13 (A) | FIG. 14 (A) | ◎ | ◎ | ◎ | Thickness: 70 μm Cross-sectional area ratio of metal powder = 78% |
| | B | FIG. 13 (B) | FIG. 14 (B) | ◎ | ◎ | ◎ | Thickness: 70 μm Cross-sectional area ratio of metal powder = 50% |
| | C | FIG. 13 (C) | FIG. 14 (C) | ◎ | ◎ | ◎ | Thickness: 70 μm Cross-sectional area ratio of metal powder = 81% |
| | D | FIG. 13 (D) | FIG. 14 (D) | ◎ | ◎ | ◎ | Thickness: 70 μm Cross-sectional area ratio of metal powder = 58% |
| | f | FIG. 13 (f) | FIG. 14 (f) | ○ | ○ | Δ | Thickness: 50–200 μm Cross-sectional area ratio of metal powder = 33% |
| Compared Conventional Mold | e | FIG. 13 (e) | FIG. 14 (e) | x | x | Δ | Thickness: 30–150 μm Cross-sectional area ratio of metal powder = 0% |

analogous to those of type A. Effective heat extraction is achieved by means of surface irregularities formed on the inner wall of the mold, in place of interposing the metal wire, with the projecting portion thereof held in contact with or in the vicinity of the heat transfer surface on the higher temperature side.

Types C and D, which are combinations of the preferred embodiments described above, also provide as satisfactory results as type A.

The bonding layer of type A is formed by first making holes of 80 μm diameter in a metal frame at intervals of 100 μm, with 70 μm diameter wires stretched in one direction. To the wired metal frame mounted on the inner wall of the mold are bonded ceramic tiles with an organic adhesive by applying a given pressure. Finishing is applied when the adhesive has thoroughly solidified. By this method, a bonding layer having a uniform high heat conductivity can be easily obtained. In addition to the one-way wired embodiment just described, a two-way wired embodiment, by forming a net-like pattern with wires stretched at right angles with each other. The net-like grooves in type B can be easily made by machining.

With the preferred embodiments of types A, B, C and D, the ratio of the cross-sectional area occupied by the added metal (to be more specific, the ratio of the area the added metal occupies in the vertical cross section of the bonding layer) can be varied as shown in the planar configurations of the bonding layer in Table 4. Then, satisfactory adhesive strength can be obtained by thus attaining a higher metal density in the upper portion and a lower metal density in the lower portion and by increasing the bonding area of the adhesive within the temperature limit tolerable by the adhesive.

Figure 16B:
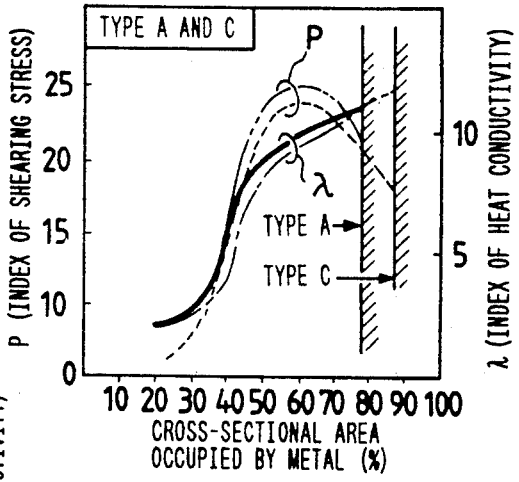
FIGS. 16(*a*), (*b*) and (*c*) graphically show the relationships between the ratio of the cross-sectional area occupied by metal, the shearing stress (P) and the index of heat conductivity (λ)
Figure 16A:
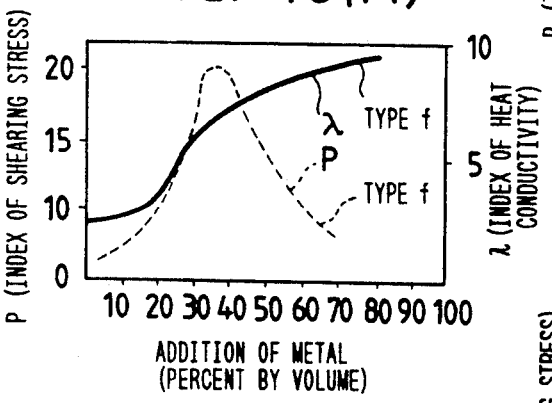
Figure 16C:
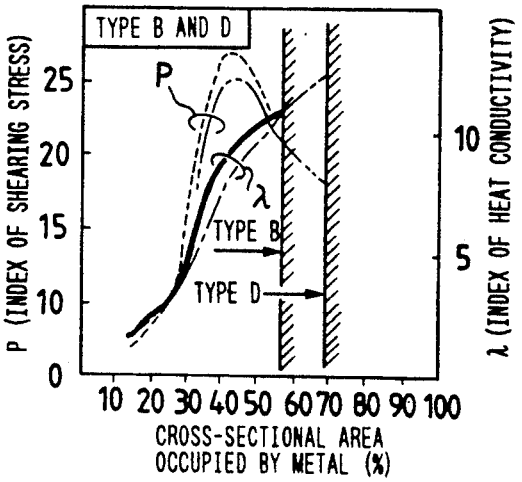

FIGS. 16(*a*), (*b*) and (*c*) show the relationships among the index of shearing stress (P), index of heat conductivity (λ) and the cross-sectional area occupied by the added metal of types f and A to D shown in Table 4. Obviously, the preferred embodiments of this invention exhibit much higher shearing stress and heat conductivity.

The percentage cross-sectional area occupied by the added metal should be kept between 25 and 85 percent. The higher the percentage cross-sectional area occupied by the added metal, the higher the heat conductivity. Then, the temperature of the bonding layer drops to enhance the soundness of the bonding layer. On the other hand, however, adhesive strength decreases as a result of a decrease in the bonded area. In FIGS. 16(*b*) and (*c*), the upper limits of the percentage cross-sectional area occupied by the added metal are indicated by hatching. The upper limits are those tolerable for satisfactory bonding.

When the percentage drops, by contrast, heat conductivity is reduced to cause the temperature of the bonding layer to exceed the upper limit of the temperature tolerable by the adhesive. Then, the likelihood of the ceramic tiles and adhesive spalling due to deterioration under high temperatures increases. Therefore, the percentage should preferably be kept between 85 and 39.3 percent with the metal wire type (types A and C) and between 68.5 and 25.0 percent with the grooved type (types B and D). Good heat extraction and adhesive strength are obtained when the percentage is between 78.5 and 39.3 percent with type A, between 55 and 25 percent with type B, between 85 and 39.3 percent with type C, and between 68.5 and 25.0 percent with type D.

In the preferred embodiments just described, the higher temperature heat transfer surface of the ceramic tiles on the molten metal side and the lower temperature heat transfer surface on the copper mold lining side are brought into direct contact by means of the metal having good thermal conductivity, thereby forming a bonding layer that assures the transfer of heat at high temperatures. Because, in addition, the metal portion and adhesive are handled individually, the viscosity of the adhesive remains undamaged. As the metal occupies a greater portion of the bonding layer, heat conductivity can be increased without lowering the adhesive strength of the bonded joint.

EXAMPLE 5

In this preferred embodiment, the thickness of the ceramic lining is varied both in the withdrawing direction of the casting and along the width of the mold.

Table 5 shows the results of bloom and slab casting achieved by varying the thickness of the ceramic lining as described above.

TABLE 5

| | Embodiments of This Invention | | | | Compared Conventional Molds | |
|---|---|---|---|---|---|---|
| Description | L | M | N | O | X[1] | Y[1] |
| Size of Mold Frame (mm) | 290 sq. | 250 × 980 | 250 sq. | 250 × 980 | 250 × 980 | 250 × 980 |
| Size of Ceramics Piece (mm) | 150 × 300 | 150 × 300 | 100 × 200 | 150 × 300 | — | — |
| Thickness of Ceramics Piece at Different Parts of Mold Height (mm) | | | | | | |
| Top End | 120 | 120 | 120 | 120 | — | — |
| Upper Part | 15 | 15 | 20 | 15 | Ni—Cr plated | Ni—Cr plated |
| Middle Part | 9 | 7 | 10 | 7 | " | " |
| Lower Part | 8 | 10 | 7 | 10 | " | " |
| Thickness of Ceramics Piece at Different Parts of Mold Width (mm) | | | | | | |
| Middle | The same as above | The same as above | The same as above | The same as above | The same as above | The same as above |
| At and near the end | Above + 0.5 mm (Corner) | Above + 1.0 mm | Above + 1.5 mm | Above + 1.0 mm | The same as above | The same as above |
| Type of Cast Steel | Al—Si—K | L(C)Al—K | Peritectic steel (C) = 0.10% Al—Si—K | L(C)Al—K | Peritectic steel (C) = 0.09% Al—Si—K | L(C)Al—K |
| Mold Oscillation | Applied | Applied | Applied | Not applied | Applied | Applied |

TABLE 5-continued

| Description | Embodiments of This Invention | | | | Compared Conventional Molds | |
|---|---|---|---|---|---|---|
| | L | M | N | O | X[1] | Y[1] |
| Casting Speed (m/min) | 0.6 | 1.2 | 0.8 | 1.0 | 0.8 | 1.2 |
| Mold Powder | Not used | Not used | Not used | Not used | Used | Used |
| Mold Superheating Temperature (°C.) | 16 | 18 | 16 | 15 | 14 | 18 |
| Evaluation | | | | | | |
| Surface Condition | Good | Good | Good | Good | Many bleeding marks at corners | Bleeding marks at corners |
| Oscillation Mark | None | None | None | None | Present | Present |
| Impression at Corner End | None | None | None | None | Present | Present |
| Overall | ⊚ | ⊚ | ⊚ | ⊚ | x | x |

As is obvious from Table 5, the castings made by the use of the molds according to this invention were free from surface defects, oscillation marks and impressions at the corners. This was due to the fact that a substantially uniform cooling capacity was secured across the width of the mold by controlling the thickness of the lining in that direction. By contrast, the aforementioned surface defects occurred on the castings made for the purpose of comparison, using conventional molds. This was due to the nonuniform cooling capacity across the width of the mold, which resulted from the higher cooling capacity in the proximity of the ends of the mold width than in the middle.

EXAMPLE 6

The ceramic lining of this preferred embodiment is curved in the upper portion thereof.

Table 6 shows the results of bloom and slab casting achieved by varying the radius of curvature of the curved portion of the ceramic lining.

As is obvious from Table 6, the castings made by use of the molds according to this invention (designated by P-S) were free from surface defects, oscillation marks and breakouts. This was due to the component of the withdrawing force in the direction of the radius of curvature of the curved portion acts in such a manner as to separate the solidifying shell from the inner surface of the mold, thereby decreasing the friction therebetween. By contrast, pronounced oscillation marks occurred on the castings made for the purpose of comparison, using conventional molds without the curved portion that reduces unwanted friction.

EXAMPLE 7

The inner surface of the mold described hereunder is tapered in the direction in which the casting is withdrawn.

Table 7 shows the results of bloom and slab casting achieved by using a mold whose inner surface narrows downward and one whose inner surface flared downward.

TABLE 6

| Description | Embodiments of This Invention | | | | | Compared Conventional Molds | |
|---|---|---|---|---|---|---|---|
| | P | Q | | R | S | X[2] | Y[2] |
| Size of Mold Frame (mm) | 290 sq. | 250 × 980 | 250 × 980 | 250 sq. | 250 × 980 | 250 × 980 | 290 sq. |
| Size of Ceramics Piece (mm) | 150 × 300 | 150 × 300 | 150 × 300 | 150 × 300 | 150 × 300 | — | — |
| Thickness of Ceramics Piece at Different Parts of Mold Height (mm) | | | | | | | |
| Maximum Thickness at Top End | 150 – 15 | 150 – 15 | 150 – 15 | 120 – 11 | 150 – 15 | | |
| Inner Radius of Curvature | R = 100 | R = 80 | R = 80 | R = 30 | R = 300 | | |
| Upper Part | 15 | 15 | 15 | 15 | 15 | Ni—Cr plated | Ni—Cr plated |
| Middle Part | 7 | 7 | 7 | 7 | 7 | " | " |
| Lower Part | 10 | 10 | 10 | 10 | 10 | " | " |
| Type of Cast Steel | Al—Si—K | L(C)Al—K | L(C)Al—K | Al—Si—K | L(C)Al—K | Al—Si—K | Al—Si—K |
| Mold Oscillation | Applied | Applied | Not applied | Not applied | Applied | Applied | |
| Casting Speed (m/min) | 1.1 | 1.4 | 1.4 | 1.2 | 1.2 | 1.6 | 1.4 |
| Cooling Pattern | Upper part intense cooling | Upper part intense cooling | Upper part intense cooling | Upper part intense cooling | Upper part intense cooling | S-curve cooling | S-curve cooling |
| Mold Powder | Not used | Not used | Not used | Not used | Not used | Not used | Not used |
| Mold Superheating Temperature (°C.) | 15 | 17 | 16 | 15 | 15 | 18 | 16 |
| Evaluation | | | | | | | |
| Surface Condition | Good | Good | Good | Good | Good | Good | Pronounced oscillation mark |
| Oscillation Mark | None | None | None | None | None | None | |
| Breakout | None | None | None | None | None | Occurred | Possibility is strong |
| Overall | ○ | ○ | ○ | ○ | ○ | x | x |

TABLE 7

| Description | Embodiments of This Invention | | Compared Conventional Molds | |
|---|---|---|---|---|
| | T | U | X[3] | Y[3] |
| Size of Mold Frame (mm) | 290 sq. | 250 × 980 | 250 × 980 | 290 sq. |
| Size of Ceramics Piece (mm) | 150 × 300 | 150 × 300 | — | — |
| Thickness of Ceramics Piece at Different Parts of Mold Height (mm) | | | | |
| Upper Part | 15 | 15 | Ni—Cr plated | Ni—Cr plated |
| Middle Part | 7 | 7 | " | " |
| Lower Part | 10 | 10 | " | " |
| Type of Cast Steel | Al—Si—K | L(C)Al—K | Peritectic steel (C) = 0.09% Al—Si—K | Peritectic steel (C) = 0.09% Al—Si—K |
| Mold Oscillation | Applied | Not applied | Applied | Applied |
| Casting Speed (m/min) | 0.6 | 1.2 | 1.2 | 0.9 |
| Cooling Pattern | Upper part intense cooling | Upper part intense cooling | S-curve cooling | S-curve cooling |
| Taper Index | −0.3 | +0.5 | +3.0 | +2.0 |
| Thickness of Fusion Zone (mm) | 1.0 | 0.5 | | |
| Mold Powder | Not used | Not used | Used | Used |
| Mold Superheating Temperature (°C.) | 13 | 19 | 18 | 15 |
| Evaluation | | | | |
| Mold Wear Index | 0.8 | 0.9 | 1.1 | 1.0 |
| Breakout | None | None | Sometimes | Sometimes |
| Overall | ⊚ | ⊚ | x | x |

As is obvious from Table 7, the molds according to this invention (designated by T and U) proved to exhibit a longer service life without causing breakouts. This was due to the fact that air gap formation between the inner surface of the mold and the solidifying shell is prevented by controlling the thickness of the lining and adjusting the taper of the inner surface of the mold according to the deformation (creeping and bulging) of the solidifying shell under the static pressure of the molten metal. By contrast, breakouts occurred on the castings made for the purpose of comparison, using conventional powdered molds. The occurrence of breakouts was due to the air gaps formed between the inner surface of the mold and the solidifying shell where uniform distribution of the mold powder and, therefore, adequate heat extraction were not attained.

What is claimed is:

1. A continuous-caster mold having a water-cooled inner mold wall of copper or a copper alloy that is lined throughout with pieces of a nitride ceramic taken from the group consisting of boron nitride and silicon nitride.

2. A continuous-caster mold comprising:

a water-cooled inner mold wall of copper or a copper alloy; and a lining of pieces of a nitride ceramic material taken from the group consisting of boron nitride and silicon nitride, formed on the inner wall and having resistance to abrasive wear, heat and thermal shock, and heat conductivity and having a lubricating property, said lining having an inner surface exposed to and defining the shape of metal being cast, the thickness of the lining being varied in the direction in which the cast metal is withdrawn from the mold for preventing formation of air gaps between the inner surface of mold and the solidifying shell of the metal being cast and the variation in thickness and the thermal conductivity of said nitride ceramic material together causing cooling of the cast metal according to the desired cooling pattern.

3. A continuous-caster mold according to claims 1 or 2, in which the lining in the proximity of the molten metal surface has sufficient thickness to prevent escape of heat from the molten metal in the vicinity of the surface to thereby cause the solidification of the molten metal to start at a point lower than the molten metal surface.

4. A continuous-caster mold according to claims 1 or 2, in which a heat-insulating clearance is provided between the inner mold wall and the inner lining in the proximity of the molten metal surface to prevent escape of heat from the molten metal in the vicinity of the surface to thereby cause the solidification of the molten metal to start at a point lower than the molten metal surface.

5. A continuous-caster mold according to claims 1 or 2, in which the upper portion of the mold has a block-like heat-insulating layer thereon to prevent escape of heat from the molten metal in the vicinity of the surface to thereby cause the solidification of the molten metal to start at a point lower than the molten metal surface.

6. A continuous-caster mold according to claim 1 or 2, in which the mold has a rectangular cross section and the thickness of the inner lining is larger in the proximity of the ends of each side of the rectangle than in the middle thereof.

7. A continuous-caster mold according to claim 6, in which the thickness of the inner lining in the proximity of the ends of each side of the rectangle is larger by 0.3 to 3.0 mm than in the middle thereof.

8. A continuous-caster mold according to claim 1 or 2, in which the inner surface of the upper part of the mold is curved around the entire periphery thereof, the arc of the curved portion extends downwardly and outwardly in the withdrawing direction, the angle defined by the top and bottom ends of the arc does not exceed 90 degrees and the starting point of molten metal solidification is at the level of the curved portion.

9. A continuous-caster mold according to claim 8, in which the radius of curvature of the curve is between 30 and 300 mm.

10. A continuous-caster mold according to claim 1 or 2, in which the inner lining is formed by pieces of ceramic bonded to the inner mold wall with an organic adhesive mixed with a metal powder or metal fibers.

11. A continuous-caster mold according to claim 1 or 2, in which the inner lining is formed by pieces of ceramic bonded to the inner mold wall with an organic adhesive, with metal wire netting interposed between the inner mold wall and the ceramics pieces.

12. A continuous-caster mold according to claim 1 or 2, in which the inner lining is formed of pieces of ceramic bonded to the inner mold wall with an organic adhesive, the inner mold wall having surface irregularities therein including projecting portions, the ceramic pieces being held in contact with the projecting portions.

13. A continuous-caster mold according to claim 1 or 2, in which the inner lining is formed of pieces of ceramic bonded to the inner mold wall with an organic adhesive, the inner mold wall having surface irregularities therein including projecting portions, the ceramic pieces being held in the vicinity of the projecting portions.

14. A continuous-caster mold according to claim 1 or 2, in which the inner lining is formed by pieces of ceramic that are bonded to the inner mold wall in an irregular pattern.

15. A continuous casting process which comprises using a mold having a water-cooled inner wall of copper or a copper alloy covered with a lining of pieces of a nitride ceramic taken from the group consisting of boron nitride and silicon nitride and having resistance to abrasive wear, heat and thermal shock, and heat conductivity and having a lubricating property, the thickness of the lining varying in the direction in which the cast metal is withdrawn from the mold, solidifying the molten metal by extracting heat therefrom, and withdrawing the solidifying metal smoothly under the effect of the solid lubrication provided by said nitride ceramic.

16. A continuous casting process which comprises the steps of:

preparing a mold having a water-cooled inner wall of copper or a copper alloy covered with a lining of a nitride ceramic material taken from the group consisting of boron nitride and silicon nitride having resistance to abrasive wear, heat and thermal shock, and heat conductivity, and having a lubricating property, the thickness of the lining varying in the casting direction with the thickness being larger in the proximity of the molten metal surface than elsewhere so that solidification of the molten metal starts below the molten metal surface;

pouring the molten metal into the mold from above; and causing the solidifying shell of the molten metal to form and grow by extracting heat from the molten metal through the inner lining and water-cooled inner mold wall.

17. A continuous casting process according to claim 16, in which solidification of the molten metal is started at a point at least 30 mm below the molten metal surface.

18. A continuous casting process according to claim 16, in which the variation in the thickness of the inner lining is such as, at the thermal conductivity of said nitride ceramic, to cause the metal being cast to be cooled according to the desired cooling pattern while preventing the formation of air gaps between the inner surface of the mold and the solidifying shell.

19. A continuous casting process according to claim 15 or 16, in which the mold has a rectangular cross section and the inner lining has a larger thickness in the proximity of the ends of each side of the mold than in the middle thereof.

20. A continuous casting process according to claim 19, in which a mold whose inner surface of the upper part is curved around the entire periphery thereof is used, the arc of the curved portion extending downwardly and inwardly in the withdrawing direction, the angle defined by the top and bottom ends of the arc not exceeding 90 degrees, the starting point of molten metal solidification being at a level in the curved portion, whereby the friction between the inner surface of the mold and the solidifying shell is reduced by the component of the withdrawing force that acts in the direction of the radius of curvature.

21. A continuous casting process according to claim 15 or 16, in which solid lubrication is provided between the inner surface of the mold and the solidifying shell by taking advantage of the lubricating property of the ceramics inner lining.

22. A continuous casting process according to claim 21, in which casting is performed without oscillating the mold.

23. A continuous casting process according to claim 15 or 16, in which the mold inner wall is tapered according to the amount of creep deformation of the solidifying shell due to the molten metal static pressure which the molten metal exerts on the solidifying shell, for reducing the friction between the inner surface of the mold and the solidifying shell.

24. A continuous casting process according to claim 16, further comprising connecting a tundish to the mold by a pouring tube of a heat insulating material, covering the top opening of the mold to prevent exposure of the molten metal therein to the atmosphere, and pouring the molten metal from the tundish into the mold through the pouring tube.

25. A continuous casting process according to claim 23, in which the taper index with respect to the line extending in the withdrawing direction is kept between $-2.0$ and $+1.8$.

* * * * *